United States Patent [19]

Yamashita et al.

[11] Patent Number: 4,601,876

[45] Date of Patent: Jul. 22, 1986

[54] SINTERED FE-CR-CO TYPE MAGNETIC ALLOY AND METHOD FOR PRODUCING ARTICLE MADE THEREOF

[75] Inventors: Michio Yamashita; Setsuo Fujimura, both of Kyoto, Japan

[73] Assignee: Sumitomo Special Metals Co., Ltd., Osaka, Japan

[21] Appl. No.: 640,111

[22] Filed: Aug. 13, 1984

Related U.S. Application Data

[62] Division of Ser. No. 297,622, Aug. 31, 1981, abandoned.

[51] Int. Cl.[4] ..... C22C 32/00

[52] U.S. Cl. ..... 419/23; 148/104; 148/31.57; 419/25; 419/38; 419/46; 419/63

[58] Field of Search ..... 148/100, 101, 102, 103, 148/104, 105, 120, 121, 122; 419/23, 25, 33, 38, 46, 63

[56] References Cited

U.S. PATENT DOCUMENTS

| | | | |
|---|---|---|---|
| 4,009,111 | 2/1977 | Tamai et al. | 148/105 |
| 4,120,704 | 10/1978 | Anderson | 148/31.57 |
| 4,194,932 | 3/1980 | Iwata | 148/31.57 |
| 4,236,919 | 12/1980 | Kamino | 148/31.57 |
| 4,246,049 | 1/1981 | Bronner et al. | 148/31.57 |
| 4,253,883 | 3/1981 | Jin | 148/31.57 |
| 4,263,044 | 4/1981 | Inoue | 75/126 |
| 4,305,764 | 12/1981 | Iwata | 148/31.57 |
| 4,311,537 | 1/1982 | Chin | 148/108 |
| 4,324,597 | 4/1982 | Kamino et al. | 148/103 |
| 4,401,482 | 8/1983 | Green et al. | 148/104 |

FOREIGN PATENT DOCUMENTS

| | | | |
|---|---|---|---|
| 1594334 | 7/1970 | France | 148/105 |
| 55-73854 | 6/1980 | Japan | 148/31.57 |
| 55-89460 | 7/1980 | Japan | 148/31.57 |
| 56-254 | 1/1981 | Japan | 148/31.57 |
| WO81/00643 | 5/1981 | PCT Int'l Appl. | 148/103 |

*Primary Examiner*—John P. Sheehan

*Attorney, Agent, or Firm*—Burns, Doane, Swecker and Mathis

[57] ABSTRACT

A sintered Fe-Cr-Co type magnetic alloy consisting essentially of 20–35% Cr, 3–15% Co and the balance substantially of Fe and a method of producing an article made of the alloy are disclosed. The method comprises the steps of blending at least one of an Fe-Cr powder and Fe-Cr-Co powder with a carbonyl Fe-powder and a Co-powder, if necessary to make up to said alloy composition, to provide a powder blend, the average particle size of said Fe-Cr powder and Fe-Cr-Co powder being 200 mesh or smaller in size, and the surface of these powders having been activated; compacting the resulting powder blend to provide a compact; sintering the resulting compact in an atmosphere in which the total amount of oxygen and nitrogen has been restricted to not more than 3 ppm; and effecting the heat treatment and magnetization of the resulting sintered alloy.

10 Claims, 2 Drawing Figures

SINTERED FE-CR-CO TYPE MAGNETIC ALLOY AND METHOD FOR PRODUCING ARTICLE MADE THEREOF

This application is a division, of application Ser. No. 297,622, filed Aug. 31, 1981, now abandoned.

BACKGROUND OF THE INVENTION

This invention relates to a sintered Fe-Cr-Co type magnetic alloy having high density and improved magnetic properties and to a method for the production of an article made of it.

An Fe-Cr-Co type magnetic alloy containing some additives has been developed which is workable through hot- and cold-working and which is comparable to ALNICO-5 (trade name) with respect to magnetic properties. The magnetic material of this type has been widely used so far due to its improved properties.

There are many methods of producing an article made of a magnetic material on an industrial scale, for example, rolling, casting and sintering. It is impossible, however, to apply rolling to ALNICO- and ferrite-type magnetic alloys, but it is advantageous to produce the Fe-Cr-Co type magnetic alloy articles through rolling, since the magnetic alloy of this type is ductile. Therefore, many alloy compositions and a variety of manufacturing processes therefor have been proposed regarding the Fe-Cr-Co type magnetic alloy. However, usually, rolling is not desirable for mass-production of a magnetic alloy and rolling is expensive, because a series of complicated steps, i.e. forging, rolling, annealing, etc. are necessary. Thus, in general, the application of rolling is limited to the production of special shapes, e.g. plate-, or wire-shaped products. In addition, it has been thought necessary to use a variety of additives to prevent the oxidation and nitriding of chromium during melting and heat treatment in the process of manufacturing the alloy.

Casting may in general be applied to a material which is hard and brittle like the ALNICO type alloy. However, since the Fe-Cr-Co type material is ductile, it is sometimes difficult to remove castings from a runner and casting defects, such as sand inclusion and misrun, are inevitable. In addition, operational efficiency is not satisfactory. Furthermore, since a variety of additives have to be added to prevent the oxidation and nitriding of chromium during melting, casting is not attractive from an economical point of view.

On the other hand, with sintering there are no such problems as in the rolling or casting method. Sintering is suitable for the mass-production of Fe-Cr-Co type magnets on an industrial scale. However, as is well known in the art sintering has disadvantages in that the density and magnetic properties of sintered products are not satisfactory. Japanese Patent Laid-Open Specification Nos. 54-33205 and 53-43006 show that sintering density is improved by the addition of B, Si, C, etc. However, in these cases, the resulting magnetic properties are not satisfactory; $(BH)_{max}$ is not greater than 5.0 MGO. In addition, the cobalt content is more than 20%; therefore, the product is expensive.

SUMMARY OF THE INVENTION

The primary object of this invention is to provide an inexpensive sintered Fe-Cr-Co type magnetic alloy which may be mass-produced on an industrial scale.

Another object of this invention is to provide a sintered Fe-Cr-Co type magnetic alloy which has high density and improved magnetic properties including a $(BH)_{max}$ of 5.0 MGO or higher, and a method of producing this magnetic alloy and an article made of it.

Accordingly, this invention resides in a sintered Fe-Cr-Co type magnetic alloy consisting essentially of 20–35% Cr, 3–15% Co and the balance substantially of Fe.

More specifically, this invention resides in a sintered Fe-Cr-Co type magnetic alloy consisting essentially of 20–35% Cr, 3–15% Co and the balance substantially of Fe, said magnetic alloy having a density of 97% or more of the theoretical density and magnetic properties including a $(BH)_{max}$ of 5.0 $MGO_e$ or more. This invention also resides in a method of producing said magnetic alloy and an article made of this magnetic alloy through powder metallurgical techniques comprising blending an Fe-Cr-Co powder or Fe-Cr powder with a carbonyl Fe-powder and, if necessary so as to make up a target alloy composition, a cobalt-powder. The major part of each of said Fe-Cr-Co powder and Fe-Cr powder is comprised of particles not larger than 200 mesh. The resulting powder mixture is compacted to provide a green compact, and said green compact is sintered in a vacuum or a non-oxidizing atmosphere in which oxygen and nitrogen together amount to 3 ppm or less.

In addition, this invention resides in a method of producing an article made of a sintered Fe-Cr-Co type magnetic alloy consisting essentially of 20–35% Cr, 3–15% Co and the balance substantially of Fe, which comprises the steps of: blending at least one of an Fe-Cr powder and Fe-Cr-Co powder with a carbonyl Fe-powder and, if necessary, a Co-powder to provide a powder blend, the average particle size of said Fe-Cr powder and Fe-Cr-Co powder being 200 mesh or smaller in size, and the surface of these powders having been activated; compacting the resulting powder blend to provide a compact; sintering the resulting compact in an atmosphere in which the total amount of oxygen and nitrogen has been restricted to not more than 3 ppm; and effecting the heat treatment and magnetization of the resulting sintered alloy.

Furthermore, this invention also resides in a method of producing an article made of a sintered Fe-Cr-Co type magnetic alloy i.e., a sintered Fe-Cr-Co type magnet consisting essentially of 20–35% Cr, 3–15% Co and the balance substantially of Fe, which comprises the steps of: blending at least one of an Fe-Cr powder and Fe-Cr-Co powder with a carbonyl Fe-powder and, if a make-up Co-powder is necessary, a Co-powder to provide a powder blend, the average particle size of said Fe-Cr powder, Fe-Cr-Co powder and Fe-powder being 200 mesh or smaller in size and these powders having an activated surface; compacting the resulting powder blend to provide a compact; sintering the resulting compact in a vacuum or a non-oxidizing atmosphere in which the total amount of oxygen and nitrogen has been restricted to not more than 3 ppm; cooling the sintered body after sintering from 800° C. to 500° C. at a cooling rate of 5° C./min or higher without effecting solid solution treatment; and effecting heat treatment and magnetization of the resulting sintered alloy.

According to this invention, the proportion of chromium is restricted to 20–35%, since the requisite levels of magnetic properties such as residual flux density and coercive force cannot be obtained when the proportion is less than 20% or higher than 35%. Furthermore, the proportion of cobalt is restricted to 3–15%, since the requisite levels of magnetic properties including residual flux density and coercive force cannot be obtained when the proportion is less than 3%. On the other hand, when the proportion is higher than 15%, it is rather difficult to apply solid solution treatment, which is necessary under the usual conditions to provide the requisite levels of magnetic properties. In addition, since cobalt is expensive, the cost of the product increases with increase in the cobalt content, making this process impractical. The balance of this alloy is substantially Fe with impurities.

Thus, according to this invention, additives previously thought to be essential are intentionally excluded from the alloy composition. One of the important features of this invention, therefore, is that there is no need to add an element other than these elements mentioned above in order to obtain a magnetic alloy which has a density of 97% or higher of the theoretical density and a $(BH)_{max}$ of 5.0 $MGO_e$ or more. In a preferred embodiment, the magnetic alloy of this invention has a residual flux density (Br) of 13,000 G or more, a coercive force (Hc) of 580 Oe or more a maximum energy product ($(BH)_{max}$) of 5.5 $MGO_e$ or more (e.g., 6.0, 6.8) and a density of 97% or more (98, 99, 99.8%) of the theoretical density.

In the sintering atmosphere employed in this invention the combined oxygen and nitrogen content is restricted to a maximum of 3 ppm. This atmosphere corresponds to a vacuum atmosphere of $10^{-3}$ mmHg or less or to a non-oxidizing (inert) atmosphere having a dew point of −70° C. or less. Thus, this atmosphere can be established easily on an industrial scale.

Of the metal powder particles used in this invention, at least the Fe-Cr powder particles and the Fe-Cr-Co powder particles should be 200 mesh or smaller in size. Preferably, all the metal powder particles employed in this invention are 200 mesh or smaller in size. In general, it is undesirable to use extremely fine metal particles, because the additional steps required to reduce the particles add to the manufacturing cost, also, the finer the particle the more likely they are to oxidize. However, providing powder particles 200 mesh or smaller in size is not so difficult. Particularly, it is rather easy to obtain Fe-Cr or Fe-Cr-Co type powder particles 200 mesh or smaller in size, since the Fe-Cr or Fe-Cr-Co type alloy has a brittle $\sigma$-phase (sigma-phase), which is formed in a wide range of 40–60% Cr (referred to as sigma power).

One of the commercially available metal powders is a water-atomized powder. Though the surface of each of the individual particles is usually oxidized, this sort of metal powder may also be employed in this invention as far as the particles have an activated surface, which will be obtained by annealing the powder in a reducing atmosphere, e.g. an $H_2$ atmosphere.

According to this invention, the blending of a Co-powder is necessary when a ferro-chromium powder is used. However, when a sigma powder, i.e. Fe-Cr-Co powder is used, a Co-powder is not necessarily needed. The Co-powder may be used only when a make-up Co-powder is required so as to provide a predetermined alloy composition.

The reasons why this invention does not require the employment of elemental components other than chromium, cobalt and iron can be given on the basis of the following points in combination:

(1) According to this invention, a green compact is sintered in the vacuum or a non-oxidizing atmosphere in which the total amount of oxygen and nitrogen is restricted to a maximum of 3 ppm, and therefore, the oxidation and nitriding do not occur.

In the prior art, on the contrary, it is necessary to employ some additives in order to prevent oxidation and nitriding of chromium during the melting and heat treatment which are indispensable to the conventional rolling or casting method. Therefore, as long as either casting or rolling is used, the oxidation and nitriding of chromium is inevitable unless some additives are employed.

In this respect, as is apparent from the foregoing, this invention employs powder metallurgical techniques which do not require a melting step or in some cases solid solution treatment. Therefore, the alloy of this invention has no chance of being subjected to oxidation nor nitriding; and this invention does not require the employment of additives which are absolutely necessary in the prior art.

(2) According to this invention a finely-divided Fe-Cr type powder or Fe-Cr-Co type powder is used as a starting powder, most particles of which are 200 mesh or smaller in size. It has been known in the art that it is difficult to obtain a sintered Fe-Cr-Co type magnetic alloy having high density without the addition of auxiliary elements. Experimentally, a powder having a particle size of about 100 mesh has been used as a starting powder. However, it was found by the inventors of this invention that it would be easy to obtain a high density article if a starting powder, particularly Fe-Cr or Fe-Cr-Co powder having particles 200 mesh or smaller in size is used. Therefore, this invention does not require the employment of any additives. It is to be noted in this respect that employing a starting powder having particles 200 mesh or smaller in size is necesssary.

(3) Water-atomizing is one of the most used methods to mass-produce metal powder on an industrial scale. However, since the surface of the powder particles produced through the water-atomizing method has been oxidized, the addition of C, B, etc. has been essential in the prior art to improve sintering density, and the addition of these additives impairs the resulting magnetic properties.

This means that a high density article with improved magnetic properties can be obtained if a starting powder the surface of which has been activated is used. This also means that even when the metal powder produced through the water-atomizing method is used as a starting powder, these improved effects can be obtained as long as the surface of the powder has been activated.

(4) There are many kinds of Fe-powders other than the carbonyl Fe powder, e.g. atomized Fe-powder, electrolytic Fe-powder, reduced Fe-powder, etc. However, it is rather difficult to obtain a high density article when these powders are used alone or in combination. Since the carbonyl powder comprises finely divided particles and is also highly activated, it is expected that relatively high density can be achieved.

However, according to the recognition of the inventors of this invention, it is impossible to achieve such high density as a density of 97% or more of the theoretical density only by blending the carbonyl Fe powder with an Fe-Cr or Fe-Cr-Co powder having a particle size of 100 mesh or so. In this respect, the inventors found that the employment of Fe-Cr or Fe-Cr-Co metal powder particles of 200 mesh or smaller in size in combination with the carbonyl Fe powder (<<200 mesh) makes it possible to produce a high density magnetic alloy with improved magnetic properties. No additive is required.

(5) As is previously mentioned, according to one embodiment of this invention, there is no need to employ solid solution treatment which has been thought to be essential. In this embodiment, therefore, there is no chance that the powder employed is adversely affected by the surrounding atmosphere upon heat treatment, because the solid solution treatment is eliminated and the other heat treatment including annealing under the application of magnetic field, aging and so on is usually carried out at a lower temperature than the temperature at which the solid solution treatment is carried out. In addition, since this invention restricts the total amount of oxygen and nitrogen in the sintering atmosphere to no more than 3 ppm, there is substantially no adverse effect caused by the surrounding atmosphere and there is no need to incorporate additives in the alloy composition of this invention so as to prevent oxidation and and nitriding of alloying elements.

Thus, since this invention does not employ additives, which are usually required for preventing oxidation and nitriding of powders during sintering and those of sintered alloys in the heat treatment procedures, the magnetic alloy of this invention is free from disadvantages caused by the additives, such as B, C, Ti, Si, Mn, Cu, Sn, etc. In this respect, the inventors of this invention found that such additives as Ti, Si, Mn, Cu, Sn, etc. are no use in providing a sintered Fe-Cr-Co type magnetic alloy having improved magnetic properties. Therefore, this invention intentionally excludes these additives from the alloy composition of this invention.

DETAILED DESCRIPTION OF THE PREFERRED EMBODIMENT

Figure 1:
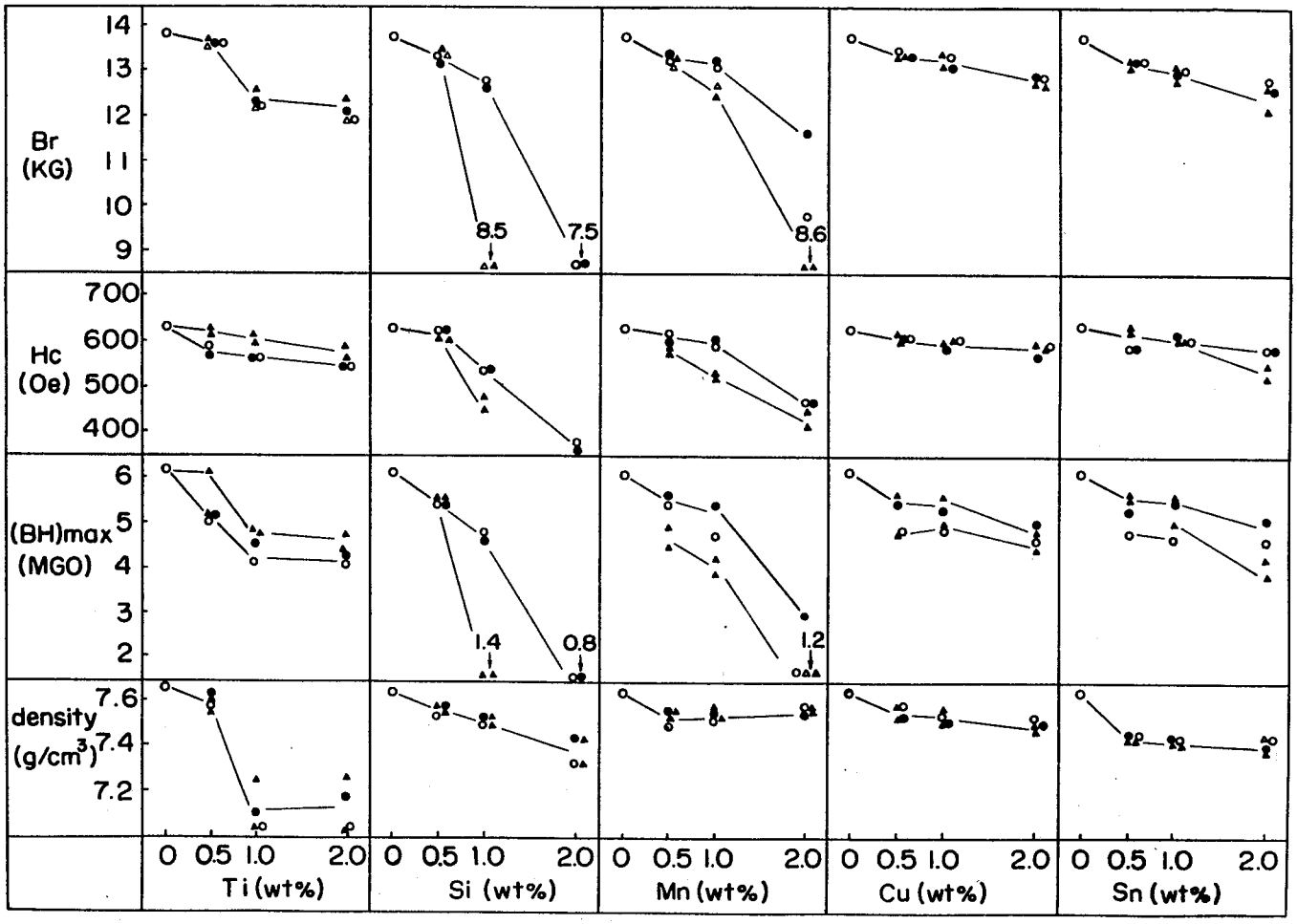
FIGS. 1 and 2 are a series of graphs showing adverse effects caused by the incorporation of conventional additives.

This invention will be described in more detail in conjunction with working examples of this invention.

EXAMPLE 1

A sigma-powder comprising 48% Cr, 18% Co and the balance of Fe was mechanically pulverized to a particle size of 200 mesh or smaller in size. The resulting powder was mixed with a carbonyl Fe-powder having an average particle size of 5μ and a Co-powder having a particle size of 400 mesh or smaller in size to provide a powder blend comprising 25% Cr, 9.5% Co and the balance of Fe, which was then compacted into a rod having a shape of 13 mm (diameter)×10 mm (length) at a pressure of 5000 Kg/cm$^2$. The resulting green compact was sintered at a temperature of 1280°–1450° C. for 2 hours under a vacuum of $10^{-3}$ Torr. The resulting sintered rod was subjected to solid solution treatment at a temperature of 1250° C. for 30 minutes and then to an isothermic heat treatment in a magnetic field of 3000 Oe at a temperature of 640° C. for one hour. Thereafter, the thus magnetized rod was cooled from 620° C. to 500° C. at a cooling rate of 3° C. per hour and maintained thereat for aging. The magnetic properties of the thus obtained magnetic alloy are summarized in Table 1 below.

TABLE 1

| No. | Sintering temperature (°C.) | Ratio to theoretical density (%) | Magnetic flux density, Br(G) | Coercive force, Hc(Oe) | Magnetic energy product $(BH)_{max}$ (MGO) |
|---|---|---|---|---|---|
| 1 | 1280 | 98.1 | 13500 | 620 | 5.6 |
| 2 | 1330 | 99.0 | 13600 | 620 | 5.8 |
| 3 | 1380 | 99.6 | 13800 | 630 | 6.2 |
| 4 | 1450 | 99.8 | 14100 | 610 | 6.8 |

EXAMPLE 2

(Comparative)

In this example, a sigma-powder and a Co-powder which were the same as in Example 1 were admixed with an atomized Fe-powder having a particle size of 100 mesh or smaller in size to provide a powder blend comprising 25% Cr, 9.5% Co and the balance of Fe. The resulting powder blend was sintered and heat treated in the same manner as in Example 1. The magnetic properties of the thus obtained magnetic alloy are summarized in Table 2 below.

TABLE 2

| No. | Sintering temperature (°C.) | Ratio to theoretical density (%) | Magnetic flux density, Br(G) | Coercive force, Hc(Oe) | Magnetic energy product, $(BH)_{max}$ (MGO) |
|---|---|---|---|---|---|
| 5* | 1280 | 94.3 | 12600 | 580 | 4.2 |
| 6* | 1330 | 95.5 | 12900 | 590 | 4.6 |

As is apparent from the data shown in Tables 1 and 2, the Fe-Cr-Co type magnetic alloy obtained in accordance with this invention shows improved magnetic properties. Particularly, as is apparent from Table 1, which shows cases in which a sigma-powder having a particle size of 200 mesh or smaller in size and a carbonyl Fe-powder were used as starting powders, and an Fe-Cr-Co type magnetic alloy having a density of 98% or more of the theoretical density and a magnetic energy product $(BH)_{max}$ of 5.5 or more was obtained over a wide range of sintering temperatures.

EXAMPLE 3

To the powder blend used in Example 2, $TiH_2$ powder having a particle size of 350 mesh or smaller in size, Fe-Si alloy powder (76.7% Si, bal. Fe) having a particle size of 250 mesh or smaller in size, Fe-Mn alloy powder (77.3% Mn, bal. Fe) having a particle size of 250 mesh or smaller in size, electrolytic copper powder having a particle size of 250 mesh or smaller in size, or Sn-powder having a particle size of 200 mesh or smaller in size was added in varying amounts of 0.5%, 1.0% and 2.0% by weight. Each of the resulting mixtures was sintered and heat treated in the same manner as in Example 1. The results are summarized in FIG. 1, in which the data of the resulting magnetic properties and density of each of the magnetic alloys are plotted with respect to the amount of each of these additives employed.

The process conditions are summarized as follows:

TABLE 3

| Sintering | Solid Solution | Magnetization | Tempering | Remark |
|---|---|---|---|---|
| 1300° C. × 4 Hr | none | 640° C. × 1 Hr | 620° C. × 1 Hr cooled at 12.5° C./hr to 575° C., and 575° C. × 3 Hr | -O- |
| 1300° C. × 4 Hr | none | 645° C. × 1 Hr | 620° C. × 1 Hr cooled at 12.5° C./hr to 575° C., and 575° C. × 3 Hr | -Δ- |
| 1350° C. × 2 Hr | 1250° C. × 20 min | 640° C. × 1 Hr | cooled to 500° C. at 2° C./hr | -●- |
| 1350° C. × 2 Hr | 1250° C. × 20 min | 645° C. × 1 Hr | cooled to 500° C. at 2° C./hr | -▲- |

As is apparent from FIG. 1, the incorporation of additives impairs the magnetic properties. The best properties were obtained when no additive was used.

EXAMPLE 4

To the powder blend used in Example 2, Fe-B alloy powder (20% B and bal. Fe) having a particle size of 250 mesh or smaller in size was added in an amount of 0.05–0.3%. The resulting mixture was then sintered and heat treated in the same manner as in Example 1.

Figure 2:
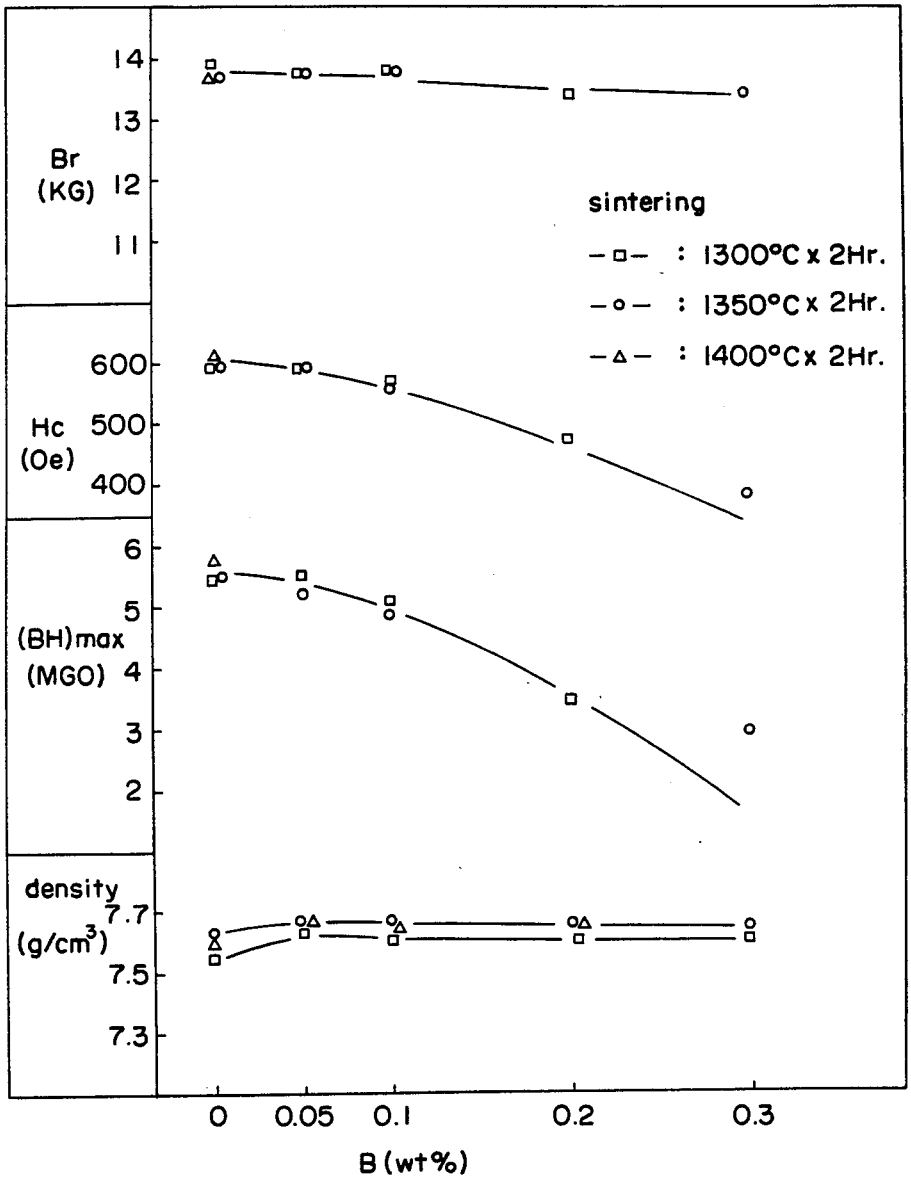

The results are summarized in FIG. 2 in which the amount of B added was shown with respect to the density and magnetic properties of the thus obtained alloy. According to the results shown in FIG. 2, though the addition of B in an amount of 0.05–0.1% seems to increase to some extent its density, the magnetic properties are degraded with increase in the amount of B added. The best results were obtained when B was not used.

EXAMPLE 5

In the same manner as in Examples 1 and 2 various starting powders shown in Table 4 below were mixed to provide powder blends comprising 25% Cr, 9.5% Co and the balance of Fe. Each of the thus obtained powder blends was compacted to provide a green compact, which was then sintered at a temperature of 1330° C. in an $H_2$ atmosphere containing oxygen in an amount of less than 3 ppm. The resulting sintered body was then subjected to aging in the same manner as in Example 1. The magnetic properties of the final products are summarized in Table 4 below.

TABLE 4

| No. | Starting powders | Ratio to theoretical density (%) | Magnetic flux density, Br(G) | Coercive force, Hc(Oe) | Magnetic energy product, $(BH)_{max}$ (MGO) |
|---|---|---|---|---|---|
| 7 | sigma-powder + carbonyl Fe-powder ferro-chromium powder + | 98.8 | 13700 | 640 | 6.2 |
| 8* | Fe-powder + Co-powder ferro-chromium powder + | 95.7 | 13000 | 540 | 4.5 |
| 9 | carbonyl Fe-powder + | 98.3 | 13800 | 580 | 6.0 |

TABLE 4-continued

| No. | Starting powders | Ratio to theoretical density (%) | Magnetic flux density, Br(G) | Coercive force, Hc(Oe) | Magnetic energy product, $(BH)_{max}$ (MGO) |
|---|---|---|---|---|---|
| | Co-powder | | | | |

NOTE: *Comparative

As is apparent from the data shown with respect to the sintered Fe-Cr-Co type magnetic alloy of this invention (Specimen Nos. 7 and 9), an improved magnetic alloy with high density and improved magnetic properties was obtained in accordance with this invention which carries out the sintering in a non-oxidizing atmosphere.

EXAMPLE 6

A sigma-powder (48% Cr, 18% Co and bal. Fe) or ferro-chromium powder (62% Cr and bal. Fe), which had been mechanically pulverized to a particle size of 200 mesh or smaller in size, was combined with various kinds of powders as shown in Table 5 below and with a Co-powder to provide a powder blend comprising 25% Cr, 9.5% Co and the balance of Fe. The resulting mixture was then compacted to provide a green compact in the same manner as in Example 1. The green compact was sintered at a temperature of 1330° C. for 2 hours in a vacuum of $10^{-3}$ Torr. The same heat treatment described in Example 1 was applied to the resulting sintered body. The density of the thus obtained magnetic alloys with respect to the theoretical density thereof is shown in Table 5 below.

TABLE 5

| No. | Starting Powder | Ratio to the Theoretical Density |
|---|---|---|
| 10* | ferro-chromium powder + atomized Fe-powder (100 mesh or smaller in size) + Co-powder | 95.1 |
| 11 | ferro-chromium powder + carbonyl Fe-powder + Co-powder | 98.8 |
| 12* | sigma-powder + atomized Fe-powder (100 mesh or smaller in size) + Co-powder | 93.9 |
| 13 | sigma-powder + atomized Fe-powder + | 97.1 |

TABLE 5-continued

| No. | Starting Powder | Ratio to the Theoretical Density |
|---|---|---|
| | carbonyl Fe-powder + Co-powder | |
| 14 | sigma-powder + carbonyl Fe-powder + Co-powder | 98.4 |
| 15* | sigma-powder reduced Fe-powder (300 mesh or smaller in size) + Co-powder | 96.2 |
| 16* | sigma-powder + electrolytic Fe-powder (100 mesh or smaller in size) + Co-powder | 94.2 |

NOTE: *Comparative

As is apparent from the data shown in Table 5 above, the sintered magnetic alloy of this invention (Specimens Nos. 11, 13 and 14) shows a high theoretical density ratio of 97% or more.

EXAMPLE 7

In this example, Example 1 was repeated except that the sintering was carried out at a temperature of 1350° C. for 2 hours and the cooling rate when cooling from 800° C. to 500° C. was varied as indicated below. The resulting alloys were subjected to heat treatment without employing solid solution treatment. The magnetic properties of the thus obtained magnetic alloys are summarized in Table 6 below.

TABLE 6

| No. | Cooling rate in going from 800° C. to 500° C. (°C./min) | Ratio to theoretical density (%) | Magnetic flux density, Br(G) | Coercive force, Hc(Oe) | Magnetic energy product, $(BH)_{max}$ (MGO) |
|---|---|---|---|---|---|
| 17 | 100 | 98.3 | 13700 | 615 | 5.9 |
| 18 | 40 | 98.0 | 13700 | 610 | 6.2 |
| 19 | 20 | 97.7 | 13700 | 605 | 6.1 |
| 20 | 5 | 97.3 | 13500 | 595 | 5.7 |
| *21 | 2 | 98.0 | 13300 | 555 | 5.05 |
| *22 | 1 | 97.9 | 13000 | 525 | 4.8 |

NOTE: *Comparative

It will be noted from the data shown in Table 6 above that as far as the cooling rate when cooling from 800° C. to 500° C. is 5° C./min or higher, then satisfactory magnetic properties can be obtained. This means that it is possible to omit the solid solution treatment which in the prior art was thought to be essential.

This invention has been explained in conjunction with Examples 1 through 7. As is apparent from them, this invention can provide an improved magnetic alloy which does not require any of the additives which in the prior art were thought to be indispensable so as to prevent the oxidation and nitriding of alloying elements, to make the heat treatment thereof easy and also to increase the density during sintering. Thus, according to this invention an improved magnetic alloy can be produced on an industrial scale, making this invention very valuable from a practical viewpoint.

What is claimed is:

1. A method of producing a sintered Fe-Cr-Co type magnet consisting essentially of 20–35% Cr, 3–15% Co and the balance substantially of Fe, which has a maximum energy product $(BH)_{max}$ of 5.0 $MGO_e$ or more comprising:

blending at least one of an Fe-Cr powder and Fe-Cr-Co powder with a carbonyl Fe-powder and, if necessary, a Co-powder to provide a powder blend, the average particle size of said Fe-Cr powder, Fe-Cr-Co powder and the carbonyl Fe-powder being 200 mesh or smaller in size;

compacting the resulting powder blend to provide a compact; and sintering the resulting compact in a vacuum or a non-oxidizing atmosphere.

2. A method of producing a sintered Fe-Cr-Co type magnet as defined in claim 1 in which the powders have an activated surface.

3. A method of producing the sintered Fe-Cr-Co type magnet as defined in claim 2, in which a sigma-powder and a carbonyl Fe-powder are used as a starting powder.

4. The method as defined in claim 2, in which said carbonyl Fe-powder is partly replaced with Fe-powder having a particle size of 200 mesh or less and an activated surface.

5. The method as defined in claim 2, in which any of said Fe-Cr powder or Fe-Cr-Co powder has been mechanically pulverized.

6. A method of producing the sintered Fe-Cr-Co type magnet consisting essentially of 20–35% Cr, 3–15% Co and the balance substantially of Fe, which has a maximum energy product $(BH)_{max}$ of 5.0 $MGO_e$ or more comprising:

blending at least one of an Fe-Cr powder and Fe-Cr-Co powder with a carbonyl Fe-powder and, if necessary, a Co-powder to provide a powder blend, the average particle size of said Fe-Cr powder, Fe-Cr-Co powder and the carbonyl Fe-powder being 200 mesh or smaller in size, the surface of these powders having been activated;

compacting the resulting powder blend to provide a compact;

sintering the resulting compact in the vacuum or a non-oxidizing atmosphere; and cooling the sintered body after sintering from 800° C. to 500° C. at a cooling rate of 5° C./min or higher.

7. A method of producing the sintered Fe-Cr-Co type magnet as defined in claim 6, in which the cooling rate from 800° C. to 500° C. is 20° C./min or higher.

8. A method of producing the sintered Fe-Cr-Co type magnet as defined in claim 6, in which a sigma-powder and a carbonyl Fe-powder are used as a starting powder.

9. The method as defined in claim 6, in which said carbonyl Fe-powder is partly replaced with Fe-powder having a particle size of 200 mesh or less and an activated surface.

10. The method as defined in claim 6, in which any of said Fe-Cr powder or Fe-Cr-Co powder has been mechanically pulverized.

* * * * *